US006817034B2

(12) United States Patent
Smilovic

(10) Patent No.: US 6,817,034 B2
(45) Date of Patent: Nov. 16, 2004

(54) MATERNITY UNDERGARMENT

(75) Inventor: Amy Smilovic, New York, NY (US)

(73) Assignee: Daisy LLC, New York, NY (US)

( * ) Notice: Subject to any disclaimer, the term of this patent is extended or adjusted under 35 U.S.C. 154(b) by 0 days.

(21) Appl. No.: 10/610,963

(22) Filed: Jul. 1, 2003

(65) Prior Publication Data

US 2004/0049831 A1 Mar. 18, 2004

Related U.S. Application Data

(60) Provisional application No. 60/392,561, filed on Jul. 1, 2002.

(51) Int. Cl.[7] ..... A41D 1/14; A41B 9/10

(52) U.S. Cl. ..... 2/73; 2/78.1; 66/171

(58) Field of Search ..... 2/73, 78.1–78.4, 2/1, 114, 80, 85, 105, 106, 104, 69, 211, 109, 243.1, 220, 221, 236, 237; 450/36, 156, 155, 3, 5, 7, 8, 10–13, 15, 16, 30; 66/171, 175–177

(56) References Cited

U.S. PATENT DOCUMENTS 1,765,937 A * 6/1930 Patten ..... 2/76
1,909,273 A * 5/1933 Hennessy ..... 450/22
1,965,860 A * 7/1934 Rutledge ..... 450/20
2,761,148 A * 9/1956 Jenckes ..... 2/73
3,054,112 A * 9/1962 McMann ..... 2/76
3,176,692 A * 4/1965 Marino ..... 450/30
3,357,435 A * 12/1967 Enrico ..... 450/7
3,949,426 A * 4/1976 George ..... 2/73
4,032,989 A * 7/1977 Jay et al. ..... 2/73
4,280,229 A * 7/1981 Stein ..... 2/221
4,506,390 A * 3/1985 Stern ..... 2/221
6,276,175 B1 * 8/2001 Browder, Jr. ..... 66/171

* cited by examiner

*Primary Examiner*—Gloria M. Hale
(74) *Attorney, Agent, or Firm*—Elman Technology Law, P.C.; Gerry J. Elman

(57) ABSTRACT

A maternity undergarment is preferably a spandex/polyester full body slip that covers, shapes and supports the upper torso and lower torso, to smooth the thigh, back waist and buttocks, slightly support the belly and optionally provide a support bra at the chest. The belly panel is of fabric that is more stretchable than the fabric covering the wearer's torso.

14 Claims, 4 Drawing Sheets

MATERNITY UNDERGARMENT

CROSS-REFERENCE TO RELATED APPLICATION

This application claims benefit of Provisional U.S. Patent Application 60/392,561, filed Jul. 1, 2002 the entire disclosure of which is incorporated herein by reference.

BACKGROUND

1. Field of the Invention

This invention relates to maternity undergarments.

2. Prior Art

Various maternity undergarments are currently on the market.

For example, the Belly Bra® acts in support function to support the lower torso and lower back lifting the weight off the pelvis and shifting it to the shoulders and back. The Belly Bra does not smooth the lines on the thigh and leg or waist.

The Prenatal Cradle® acts as a separate pc to be used over undergarments in a support function, again lifting the belly and redistributing the weight from the belly to the shoulders and the back but does not act in a girdle function.

The Maternity Longline Girdle® acts as a girdle on the lower torso supporting the belly and smoothing the thighs but does not address the waist area or bust.

The Seamless tube slip offered by Motherhood acts only as a skirt girdle smoothing the thigh area but offers no support and does not address the upper torso.

The belly belts on the market act in a support function and are separates to be worn over the undergarments.

The typical maternity undergarments create unsightly panty lines or do not cover, smooth, or shape the thigh, back, waist and leg the way a support-top pantyhose might in non-maternity garments. With the surge in contemporary and fashionable maternity clothes on the market, there is a need for an undergarment that acts as a body smoother to create smooth lines at the thigh and buttocks and back waist, creating a better fit and supporting the look and feel of more fashionable maternity clothes.

SUMMARY

The invention provides a full body slip for a mother-to-be, an embodiment of which is marketed under the trademark Mommy Shapers™. A maternity slip of the present invention acts as a body smother and definer while adding a touch of support under the belly and in the bra. Because the present invention provides a substantially seamless garment (except in some embodiments for relatively imperceptible belly and back panels) it affords the highest of comfort while giving the wearer shape and definition under her fashionable clothes without unsightly panty or bra lines.

A preferred embodiment of the invention is a spandex/polyester full body slip that covers, shapes and supports the upper torso and lower torso. Using technology and machinery currently available for fabricating clothing, I have created a seamless body shape to smooth the thigh, back waist and buttocks, slightly support the belly and provide a support bra at the chest.

Such a garment is knitted with ribbing at the under chest, and surrounding the belly. This creates a dual function of shaping and support around the belly and under the cups of the bra top. In the back there is also ribbing that allows for the shaping at the back waist and around the buttocks.

The non ribbed areas that cover the body act as a smoothing girdle, lightly hugging the body to eliminate bumps and dimples on the thighs, buttocks, and back waist caused by the extra pounds a woman gains during pregnancy.

In one embodiment, the combination of ribbing and jersey areas eliminate the need for seams that cause unsightly lines. The lightweight poly/spandex material of the preferred embodiment breathes well. Preferably it has a 4× stretch which allows for comfort and flexibility.

In another embodiment, a mesh insert of high-stretch fabric covers the belly, the seams being configured such that they are not apparent under the wearer's outer clothes.

The invention provides a maternity undergarment comprising a bust section, a torso section and a skirt section, the torso section including a belly panel of a more-stretchable fabric, the belly panel being surrounded by fabric that is less stretchable than the belly panel, the torso section being thereby adapted to accommodate the changing proportions of a pregnant woman's belly and to provide gentle support thereto while smoothing and shaping her overall silhouette.

Preferably the skirt section is of a fabric that is less stretchable than the belly panel, e.g. it may be of the same fabric as the "less-stretchable fabric" of the torso section.

The bust section of the undergarment may include a brassiere section.

Such a brassiere section may be supported by a pair of straps adapted to be secured to any of a plurality of anchor points atop the brassiere section, whereby the straps may be adjusted as desired to accommodate changes in bust proportion of the wearer.

The belly panel is desirably a stretchable mesh fabric, e.g. tricot mesh of polyamide/spandex, and the rest of the torso section is a less-stretchable fabric, e.g. a polyester/spandex blend.

The undergarment may also have a V-shaped back panel of fabric different from the fabric of the rest of the torso section.

In an embodiment of the invention, the torso section is knitted so as to provide less-stretchable ribbing around the belly panel.

The bust section desirably comprises a brassiere section, and preferably the torso section is knitted to provide less-stretchable ribbing below the front of the brassiere section and around the top of the back of the torso section.

Optionally the brassiere section is supported by a pair of straps adapted to be secured to any of a plurality of anchor points atop the brassiere section, whereby the straps may be adjusted as desired to accommodate changes in the wearer's bust proportions.

An advantage of the present invention is that a pregnant woman can wear slim-fitting maternity clothes without having unsightly panty lines. Another advantage is that she can wear tight or clinging maternity clothes without having the bumps and dimples-created by the extra pounds she has gained through pregnancy be obvious in her thighs, hips and buttocks, and back area. A further advantage is that a pregnant woman wearing a garment of the present invention can have some slight support under her belly, gently lifting the belly from the pelvis and hip carriage. Another advantage is that she can wear a single garment functioning as both a slip and bra.

Other advantages and features of the invention will become apparent from a study of the following description and accompanying drawings.

DETAILED DESCRIPTION

Figure 1:
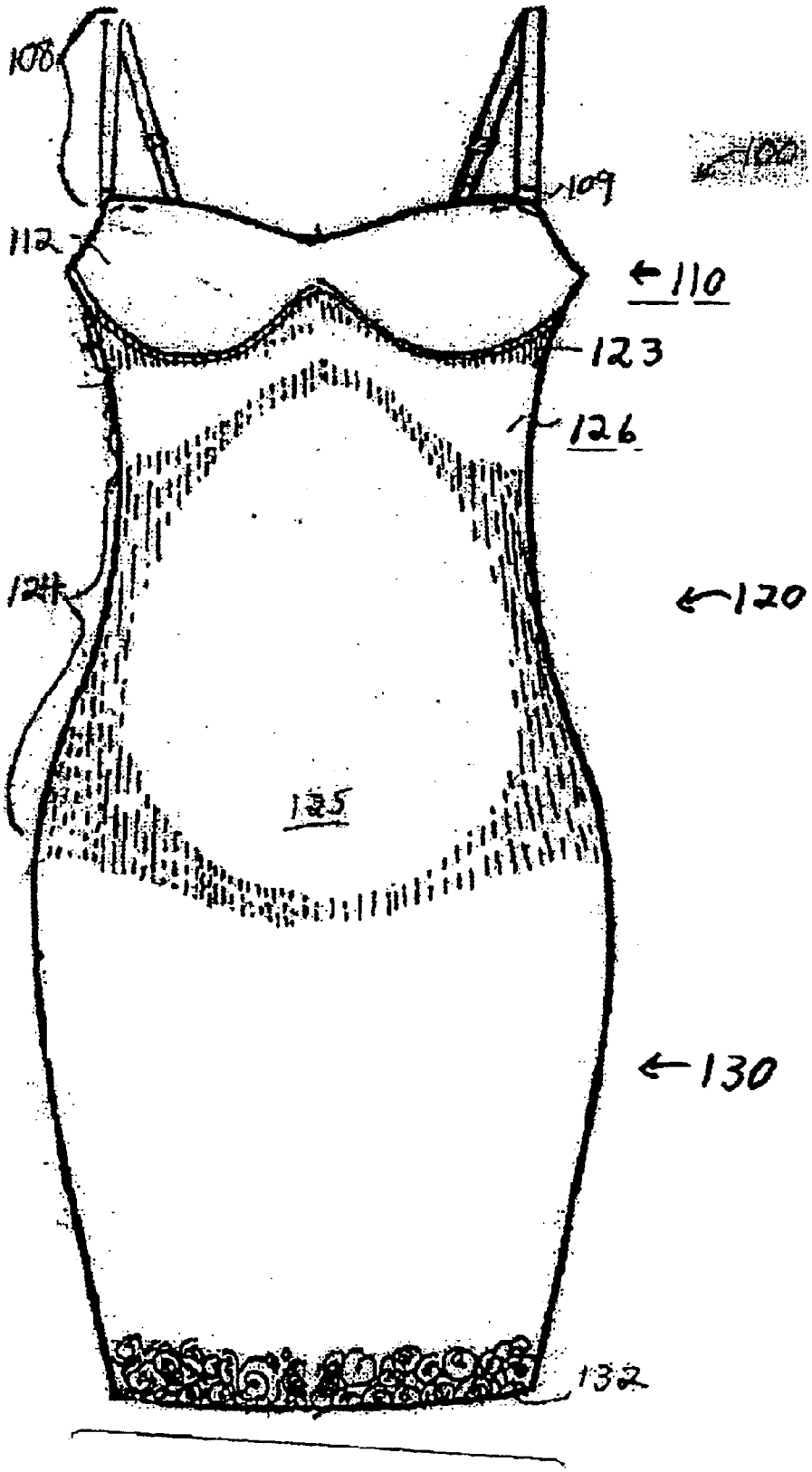
FIG. 1 is a full frontal perspective of a maternity garment of the invention as draped on a woman's figure.

FIG. 1 is a full frontal perspective of a first embodiment 100 of the maternity garment of the invention on a woman's figure; it shows the total silhouette of the garment. As worn, the garment generally envelopes the woman's bust, the rest of her torso, and her thighs. In this embodiment, her bust is supported by a brassiere section 112 provided in the bust section 110 of the garment. The torso below her bust is gently but elastically enwrapped by a torso section 120, and at least the top of her thighs are similarly enwrapped by a skirt section 130 extending downwardly from the torso section to a generally horizontal hem 132 at thigh level.

In accordance with the invention, the torso section 120 is adapted to provide for the changing proportions of her abdomen. In the embodiment of FIG. 1, this is accomplished by providing ribbing, e.g. 122, knitted into the section so that different portions of the torso section 120 have different stretch characteristics. The area that generally covers the abdomen, i.e. the belly panel 125, is knitted relatively smoothly and is thereby made relatively stretchable, whereas the under-chest 123 and area surrounding the belly 124 are knitted with ribbing so as to create a dual function of shaping and support around the belly 124 and under the cups of the bra top, as at 123. As shown more particularly in FIGS. 2 and 3, in the back there is also ribbing 122 that allows for the shaping of the back waist and around the buttocks.

Figure 2:
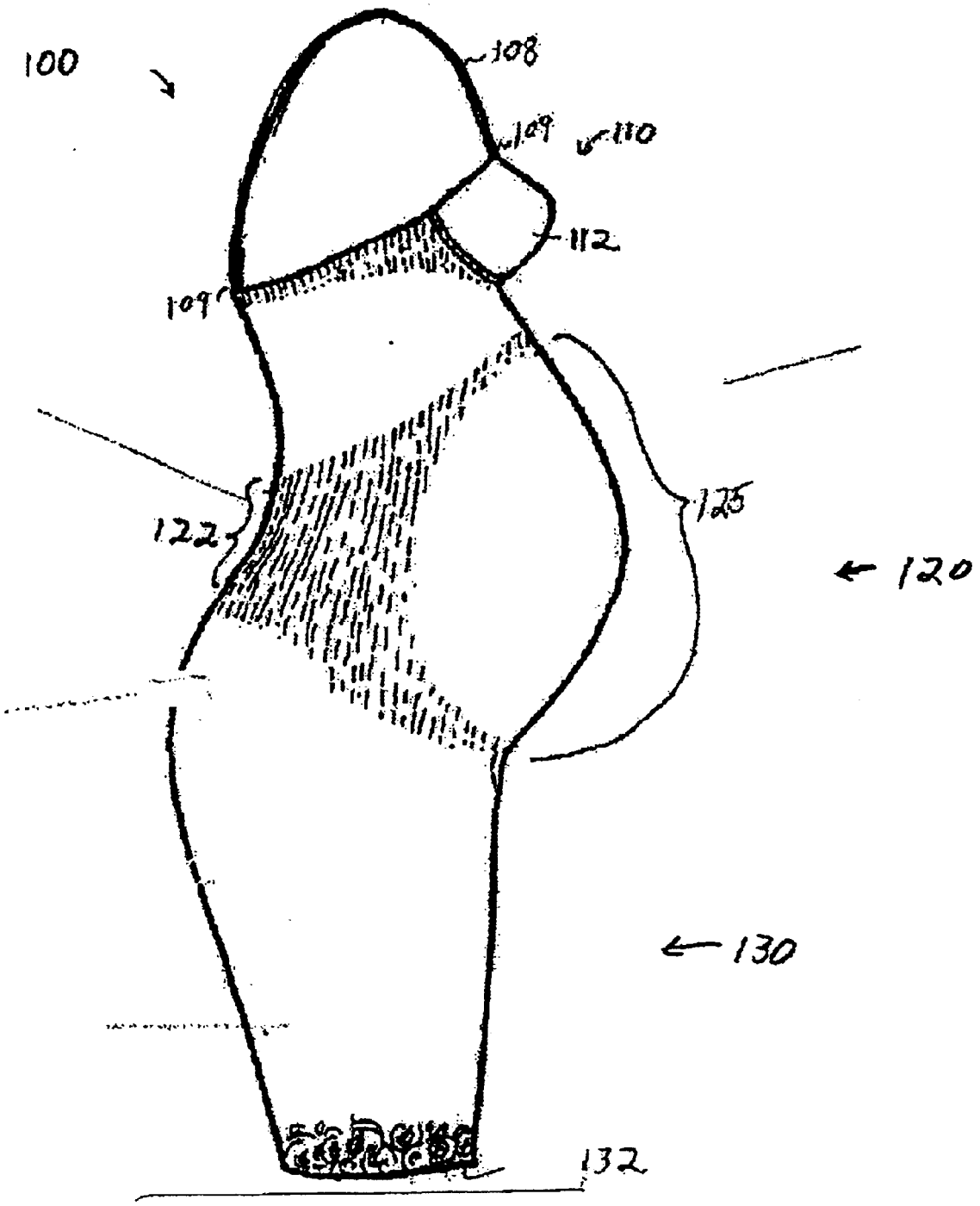
FIG. 2 is a side perspective of the garment of FIG. 1.
Figure 3:
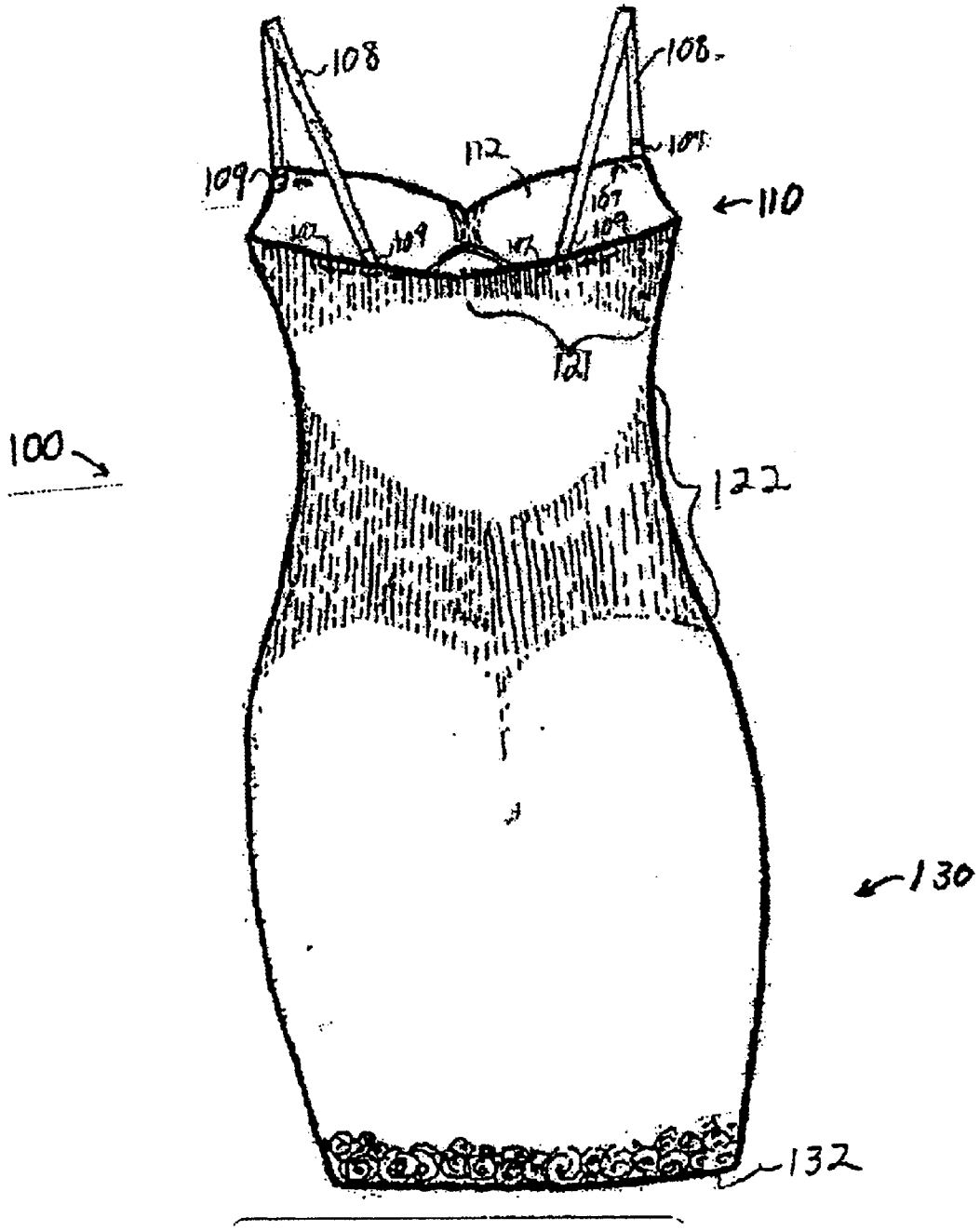
FIG. 3 is a back perspective of the garment of FIG. 1.

As shown in FIGS. 1–3, the brassiere section is suspended from a pair of 5-way straps 108 provided to go over the wearer's shoulders. Optionally a pair of steel hooks 109 are stitched onto both ends of each strap, and a set of loops 107 are placed at the front and back of the bodice on each side so that the straps can be attached to any of a plurality of loops and thereby adjusted side to side for the most comfortable fit at the time.

In this embodiment, the brassiere section 112 desirably includes a heat molded underwire bra, with block fusing inside the cup for additional support and ribbing for additional support. Immediately below the bra, the torso section 120 is knitted with ribbing 123, for example, 2 inches at center front and 2½ inches at side seam. Below that ribbing 123, the chest is surrounded with relatively stretchable light weight jersey knit 126 for breathability and smoothing function.

In the belly support area 125 of the torso section 120, 2 inches of ribbing, for example, may be provided below the belly for support and 1½ inches of ribbing above the belly to shape the body of the garment. The ribbing 124 shapes around the belly 125 to the waist 122 where the ribbing acts in a smooth and support function, smoothing the waist and back waist, and supporting the belly, lifting it slightly from the hips and pelvis.

The skirt section 130 extends seamlessly from the torso section and is desirably of jersey for smoothing and shaping along the thighs. Desirably the hem 132 of the skirt section is finished with stretch lace and, for example, three strips of thermoplastic polyurethane tape, e.g. Mobilon™, to reduce rolling.

In FIG. 3 can be seen the back support of the bra 112. Desirably, the ribbing 121 grows from the back to the side, creating an integrated structure like a traditional bra back. Also illustrated in FIG. 3 is the ribbing 122 at the back waist, creating a shape for the buttocks and lower back and working as a lower back support for the belly.

Figure 4:
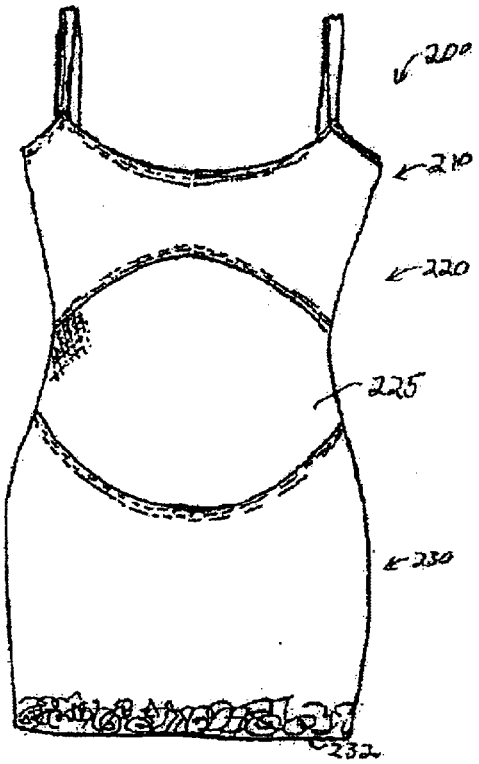
FIG. 4 is a full frontal perspective of an alternative embodiment of a maternity garment of the invention as draped on a woman's figure.
Figure 5:
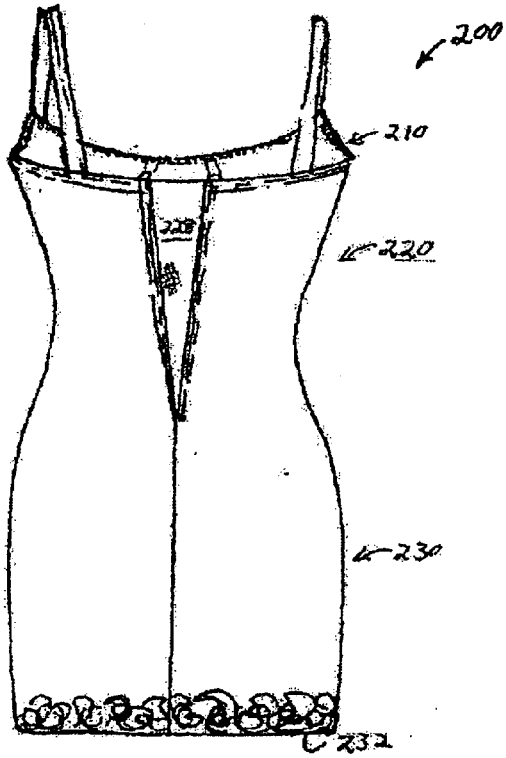
FIG. 5 is a back perspective of the garment of FIG. 4.

Turning to the maternity undergarment 200 illustrated in FIGS. 4 and 5, the body of the garment is desirably fabricated of a stretch fabric, such as 80/20 polyester/spandex. In this embodiment, FIG. 4 shows a belly insert 225 of tricot mesh provided in the torso section 220, desirably of a more stretchable 85/15 nylon polyamide/spandex. Similarly a V-shaped back insert 228 of tricot mesh is provided as shown in FIG. 5.

Optionally a brassiere section as described in connection with FIG. 1 (112) is provided; alternatively, a "slip" garment may be provided with a bust section 210 but without bra support. A hem 232 is optionally finished as described above in connection with hem 132.

In operation the wearer uses the maternity garment 100, 200 of the invention as she would use a slip or girdle. It is pulled over the head and body. Her belly fits nicely in the belly support structure comprising belly panel 125, 225, and the garment may be adjusted for maximum comfort.

The optional multi strap 108 may be adjusted for the desired strap length and position (x back, asymmetrical, racer back, traditional back, cross front).

Like a girdle, the maternity garment lifts, supports and smoothes the body shape.

The invention is not limited to the embodiments described above, but all changes and modifications thereof not constituting departures from the scope and spirit of the invention are intended to be included.

I claim:

1. A maternity undergarment comprising:

a bust section, a torso section and a skirt section, the torso section comprising a belly panel of a stretchable fabric, the belly panel being surrounded by stretch fabric that is less stretchable than the belly panel, the torso section being thereby adapted to accommodate the changing proportions of a pregnant woman's belly and to provide gentle support thereto while smoothing and shaping her overall silhouette.

2. The maternity undergarment of claim 1, wherein the skirt section is of a fabric that is less stretchable than the belly panel.

3. The maternity undergarment of claim 2, wherein the skirt section is of the same fabric as said less stretchable fabric of the torso section.

4. The maternity undergarment of claim 1, wherein the bust section comprises a brassiere section.

5. The maternity undergarment of claim 4, wherein the brassiere section is supported by a pair of straps adapted to be secured to any of a plurality of anchor points atop the brassiere section, whereby the straps may be adjusted as desired to accommodate changes in bust proportion of the wearer.

6. The maternity undergarment of claim 1, wherein the belly panel is a stretchable mesh fabric and the rest of the torso section is a less-stretchable stretch fabric.

7. The maternity undergarment of claim 6, wherein the stretchable mesh fabric is a tricot mesh and the less-stretchable fabric is a spandex blend.

8. The maternity undergarment of claim 7, wherein the tricot mesh is a polyamide/spandex blend that is more stretchable than the spandex blend of the less-stretchable fabric.

9. The maternity undergarment of claim 1, wherein the less-stretchable fabric is a polyester/spandex blend.

10. The maternity undergarment of claim 1, further comprising a V-shaped back panel of fabric different from said less-stretchable fabric of said rest of the torso section.

11. The maternity undergarment of claim 1, wherein the torso section is knitted so as to provide ribbing which is less stretchable around the belly panel.

12. The maternity undergarment of claim 11, wherein the bust section comprises a brassiere section.

13. The maternity undergarment of claim 12, wherein the torso section is knitted to provide ribbing below the front of the brassiere section and around the top of the back of the torso section.

14. The maternity undergarment of claim 12, wherein the brassiere section is supported by a pair of straps adapted to be secured to any of a plurality of anchor points atop the brassiere section, whereby the straps may be adjusted as desired to accommodate changes in the wearer's bust proportions.

* * * * *